United States Patent [19]

Neville

[11] 4,357,733

[45] Nov. 9, 1982

[54] SHOCK ABSORBING ROLLER

[75] Inventor: Donald Neville, Malibu, Calif.

[73] Assignee: Plastiglide Manufacturing Corporation, Hawthorne, Calif.

[21] Appl. No.: 918,392

[22] Filed: Jun. 23, 1978

[51] Int. Cl.[3] ..... E05D 13/02

[52] U.S. Cl. ..... 16/107; 308/3.8

[58] Field of Search ..... 16/107, 98, 97, 91; 308/3.8

[56] References Cited

U.S. PATENT DOCUMENTS

| | | | |
|---|---|---|---|
| 3,243,237 | 3/1966 | Sprecher | 308/3.8 |
| 3,361,489 | 1/1968 | Gionet | 16/97 X |
| 3,451,095 | 6/1969 | Kiefer | 16/107 |

FOREIGN PATENT DOCUMENTS

| | | | |
|---|---|---|---|
| 1259063 | 1/1968 | Fed. Rep. of Germany | 16/97 |

*Primary Examiner*—Andrew V. Kundrat

*Attorney, Agent, or Firm*—Charles H. Schwartz; Ellsworth R. Roston

[57] ABSTRACT

A shock absorbing roller mounted on a shaft and for movement along a track, including a central hub portion and with the hub portion for mounting the roller on the shaft, a peripheral roller portion surrounding the hub portion and including means interconnecting the roller portion and the hub portion for supporting the roller portion, the roller portion including a flexible circumferential flange section extending outwardly for providing contact with the track and with the flexible circumferential flange section providing shock absorption and noise reduction with movement of the roller along the track, and at least one flexible thrust flange extending outwardly from the side of the roller and with the flexible thrust flange providing shock absorption and noise reduction with any contact of the roller from side to side movement of the roller across the track.

13 Claims, 7 Drawing Figures

SHOCK ABSORBING ROLLER

The present invention is directed to a roller and specifically to a roller which may be used as part of a door roller assembly.

A common type of door assembly such as used for garage doors or truck doors includes a plurality of interlocked door panels. Each panel is hinged to the next panel and with the ends of the panels supporting rollers. The rollers are positioned within channels located to each side of the interlocked panels. The door assembly may be moved with the movement of the rollers in the side channels. For example, the door assemblies may be overhead door assemblies and with the channels radiused through 90° at a top position. As the door assembly is moved upward, the hinged interlocking panels follow the 90° radius of the channels to go from a vertical to a horizontal position.

As indicated above, the door panels are supported for movement within the channels by the use of rollers. The type of rollers currently in use are quite noisy in operation and when the door assembly is either opened or closed, the movement of the roller within the channel provides for a loud clatter. In addition, when the door assemblies as described above are used in vehicles such as trucks the movement of the door from side to side as the vehicle is driven also provides for a large amount of noise. The present invention is directed to a roller for use in assemblies, such as door assemblies, wherein the roller is much quieter in operation than conventional rollers. The roller of the present invention is quieter in operation not only when the doors are rolled up and down but is also quieter in operation when the doors move from side to side such as when the vehicle is being driven. The roller of the present invention provides for the operation of the door assembly with as much ease as with conventional rollers and also wears as well as conventional type rollers.

The roller design of the present invention allows for the roller to absorb shock and noise on both the radial surface of the roller and also on a thrust surface for the roller, such as may occur when the door moves from side to side. Specifically, the roller includes an outer roller portion having a flexible circumferential flange section extending outward from the roller so that the perimeter of the flexible flange section may contact individual ones of the parallel spaced sidewalls of the channel. This provides for a compression of this flexible flange section of the outer periphery of the roller if the roller is moved across the channel. Also, as the roller moves within the channel, such as when the door is opened and closed, the flexible flange section will flex so as to absorb shock and noise. In addition, the roller of the present invention includes a plurality of flexible thrust flanges extending from the roller toward an end wall of the channel so that as the doors move from side to side, these flexible thrust flanges can absorb shock and noise if the roller contacts the end wall of the channel.

The roller of the present invention may also include a central hub portion for mounting the roller at the end of a shaft member. The shaft member is supported at the end of individual door panels and may be coupled within the hinge portion. Extending from the central hub are a plurality of fins which support at their outer portions the outer roller portion including the flexible circumferential flange section. The flexible outwardly extending flange section extends away from the central hub and serves as the roller surface to contact the sidewalls of the channel. Extending from an end of the roller portion and toward the central hub are the plurality of flexible thrust flange members which serve to absorb shock and noise from an end wall of the channel member.

A clearer understanding of the invention will be had with reference to the following description and drawings wherein.

Figure 1:
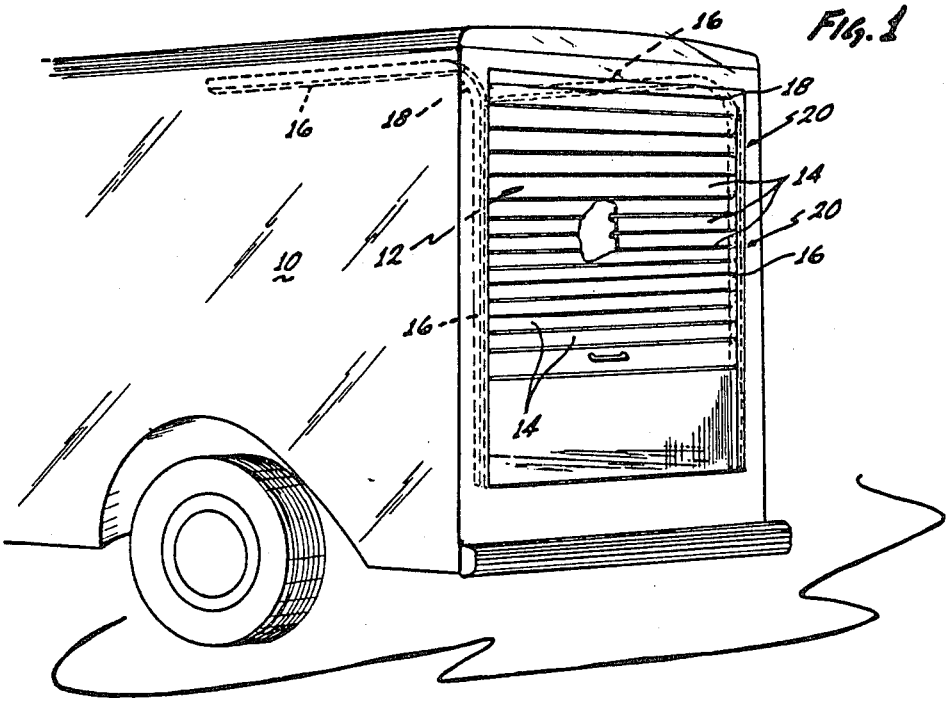
FIG. 1 illustrates the rear portion of a truck, including a door assembly composed of a plurality of door panels.
Figure 2:
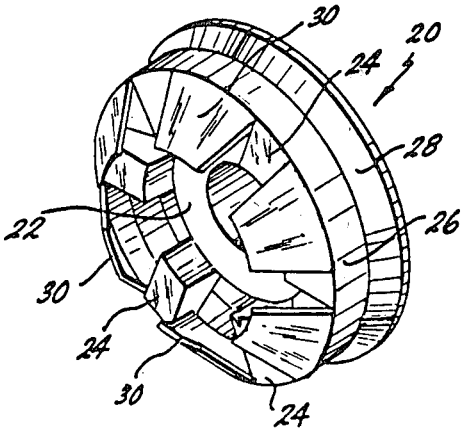
FIG. 2 illustrates a perspective view of a roller constructed in accordance with the teachings of the present invention.
Figure 3:
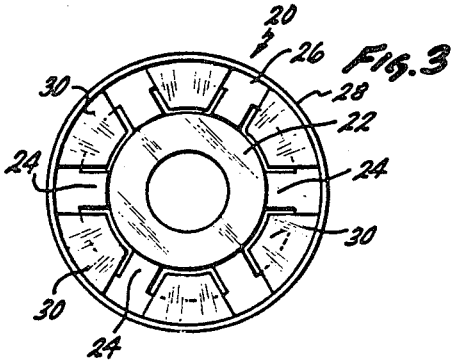
FIG. 3 illustrates a front view of the roller of the present invention.
Figure 4:
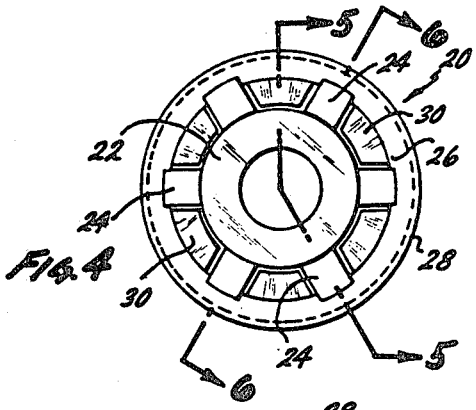
FIG. 4 illustrates a rear view of the roller of the present invention.
Figure 5:
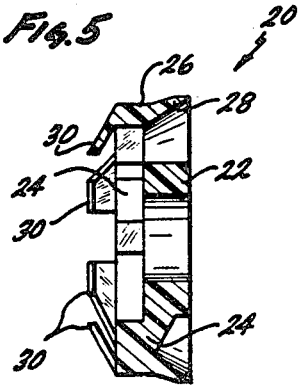
FIG. 5 illustrates a cross-sectional view taken along lines 5—5 of FIG. 4 of the roller of the present invention.

In FIG. 1, the rear portion of a truck 10, including a door assembly 12, is shown. The door assembly includes a plurality of door panels 14, and with each door panel interlocked to the adjacent door panel by an integral hinge. The door assembly has end portions including rollers positioned within channels 16 located to each side of the door assembly. The channels 16 are formed to have a radiused 90° turn as shown at positions 18. When the door assembly 12 is pulled up, the door assembly rolls around the radiused portions 18 since each panel 14 is hinged to the next. In the open position, the door assembly lies in the upper portion of the truck 10.

A structure similar to that shown in FIG. 1 may also be used with overhead garage doors and it is to be appreciated that the roller of the present invention may also be used in environments other than that shown in FIG. 1. It is also to be appreciated that the roller of the present invention may be used in any environment wherein a roller is located in a track or channel and it is desired to have the roller absorb shock and reduce noise.

FIGS. 2 through 5 illustrate in detail a roller 20 constructed in accordance with the teachings of the present invention. The roller includes a central hub portion 22 which hub portion includes an opening to receive a shaft member. Extending outwardly from the hub portion are a plurality of fins 24 which fins provide support for an outer roller portion 26 of the roller. Specifically, the roller portion 26 is a circumferential ring spaced from the hub portion 22 and with the fins 24 interconnecting the hub portion 22 and a rigid section of the roller portion 26.

The rigid section of the roller portion 26 has extending outwardly from one side a flexible circumferential flange section 28. The flexible flange section 28 actually serves to provide contact between the roller and individual sidewalls of the channel in which the roller is placed. It can be seen that the flexible flange section 28 narrows down at its outer end and is actually quite flexible in comparison with the remaining rigid section of the roller portion 26. The flexibility of the flange section 28 allows the roller to be compressed with any movement across or along the channel and to also provide for the absorption of shock and reduction of noise of the roller within the channel.

Intermediate the fins 24 and extending from the other end of the rigid section of the roller portion 26 are a plurality of thrust flanges 30. The thrust flanges extend in a direction toward the center hub portion of the roller, but away from the end of the roller portion 26. These thrust flanges 30 are relatively thin in cross-section and are thereby flexible so as to absorb shock and reduce noise from any side movement of the roller within the channel.

Figure 7:
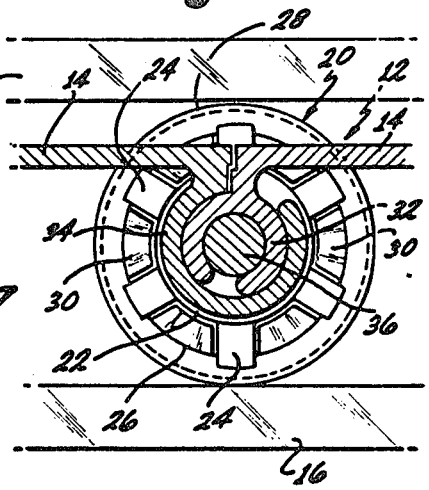
FIG. 7 illustrates a cross-sectional view of the assembly of FIG. 6 taken along lines 7—7.
Figure 6:
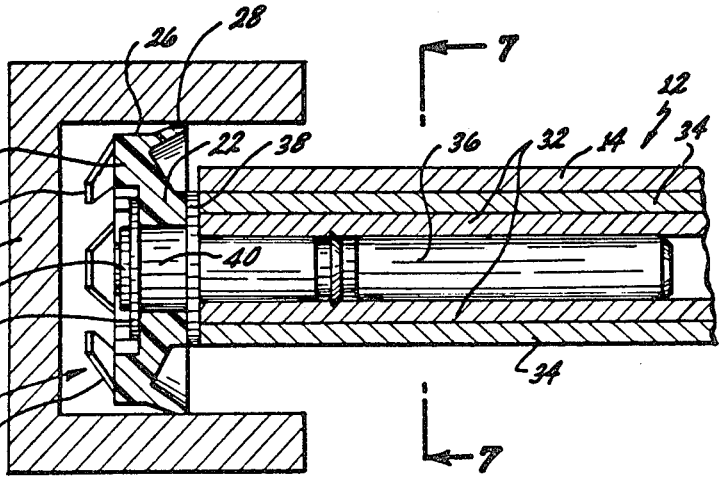
FIG. 6 illustrates a cross-sectional view of a roller of the present invention mounted at the hinge between two panels and positioned within a roller channel.

FIGS. 6 and 7 illustrate the roller of the present invention mounted on the end of a shaft member and with the shaft member inserted within an intermediate portion of the door panels 12. Specifically, as shown in FIG. 7, each door panel 12 includes interlocking hinge members. Specifically, each door panel 12 includes a hinge member 32 at one end of the panel and a hinge member 34 at the other end of the panel. The panels are interlocked by sliding the hinge member 32 within the hinge member 34 and building up the door assembly by a large plurality of such panels 12.

As shown in FIG. 6, the roller 20 is mounted on a shaft member 36 which shaft member is positioned within an opening in the hinge member 32. The shaft member 36 includes a first flange portion 38 and a roller support section 40. The roller 20 is positioned on the roller support section 40 and against flange 38. The washer member 42 is then placed over the end of the shaft 36 and the end portion of the shaft 36 is riveted over as shown at position 44 so as to lock the roller 20 for rotation on the roller support section 40 of the shaft 36.

A plurality of such rollers are mounted on shafts and are positioned within the hinge portions of the panels. Generally a pair of such roller assemblies are provided at opposite ends of each hinge portion located between adjacent panel members 12. It is to be appreciated that a lesser number of roller members may be used so that a pair of roller members may be used, for example, for every other or every third panel member.

When the door assembly, including the rollers, are positioned in the channels 16, as can be seen in FIG. 6, the flexible flange section 28 of the roller portion 26 is actually in slight contact with the sidewalls of the channel 16 so as to provide for a slight compression of the flexible flange section 28. This slight compression tends to minimize rattles and therefore reduces the noise. Also, as indicated above, because the flange section 28 is flexible the rollers of the present invention will flex during movement to absorb any shock and thereby also reduce noise. In addition, if the door assemblies move from side to side, the flexible thrust flanges 30 of the rollers will contact the end wall of the channel 16 and thereby provide for the absorption of shock and the reduction of noise.

The present invention therefore provides for a roller design which has flexible flange portions both in the radial direction and in the thrust direction so as to provide for the absorption of shock and reduction of noise with any movement of the rollers. The rollers of the present invention may be used for various types of door assemblies and have been illustrated with reference to a use for a truck door assembly. However, it is to be appreciated that the rollers may be used in other applications where it is desirable to provide for an absorption of shock and reduction of noise.

Although the invention has been described with reference to a particular embodiment, it is to be appreciated that various adaptations and modifications may be made and the invention is only to be limited by the appended claims.

I claim:

1. A shock absorbing roller mounted on a shaft and for movement along a U-shaped track having first and second oppositely disposed walls interconnected by an end wall, including a central hub portion and with the hub portion for mounting the roller on the shaft, a peripheral roller portion surrounding the hub portion and including means interconnecting the roller portion and the hub portion for supporting the roller portion, the roller portion including a circumferential ring spaced around the hub portion and having a cylindrical outer surface and a flexible circumferential flange section extending outwardly from one side of the circumferential ring toward the first and second oppositely disposed walls for providing contact with the first and second walls of the track and with the flexible circumferential flange section providing shock absorption and noise reduction with movement of the roller along the track, and at least one flexible thrust flange extending outwardly from the other side of the circumferential ring toward the end wall of the track and with the flexible thrust flange providing shock absorption and noise reduction with any contact of the roller with the end wall of the track from side to side movement of the roller across the track.

2. The shock absorbing roller of claim 1 wherein the means for interconnecting the hub portion to the roller portions includes a plurality of radially spaced fins extending from the hub portion to the roller portion and spacing and supporting the roller portion concentric with the hub portion.

3. The shock absorbing roller of claim 2 wherein the circumferential ring of the roller portion forms a rigid section having an inner surface integral with the spaced fins and with the flexible circumferential flange section extending outwardly from the one side of the rigid section and away from the spaced fins and the hub portion.

4. The shock absorbing roller of claim 3 including a plurality of spaced flexible thrust flanges and with the spaced flexible thrust flanges extending outwardly from the other side of the rigid section and away from the spaced fins and toward the hub portion axis.

5. The shock absorbing roller of claim 1 including a plurality of spaced flexible thrust flanges.

6. A roller for mounting on a shaft and for movement within a track having a U-shaped cross-section having first and second oppositely disposed walls interconnected by an end wall, including a central hub portion for mounting the roller on the shaft, a roller portion surrounding the hub portion and with the roller portion including a rigid circumferential ring section spaced around the hub portion and having a cylindrical outer surface interconnected with the hub portion, the roller portion including a flexible circumferential flange section extending outwardly from the ring section toward the first and second oppositely disposed walls from one side of the rigid circumferential ring section and away from the hub portion, and the roller when positioned within the U-shaped track having the flexible circumferential flange section providing shock absorption and noise reduction with movement of the roller across or along the track.

7. The roller of claim 6 additionally including a plurality of radially spaced fins extending from the hub portion for interconnecting the hub portion with the rigid section of the roller portion.

8. The roller of claim 6 additionally including at least one flexible thrust flange extending outwardly from the other side of the rigid section and toward the hub portion axis and with the thrust flange providing shock absorption and noise reduction with movement of the roller across the U-shaped track to contact the end wall of the track.

9. The roller of claim 7 including a plurality of spaced thrust flanges.

10. A roller for mounting on a shaft and for movement within a track having a U-shaped cross-section having first and second oppositely disposed walls interconnected by an end wall, including a central hub portion for mounting the roller on the shaft, a roller portion surrounding the hub portion and with the roller portion including a rigid ring section spaced around and interconnected with the hub portion and having one outward side wall having flat portions, at least one flexible thrust flange extending outwardly from the one outward side wall of the roller and toward the hub portion axis, and the roller when positioned within the U-shaped track having the flexible thrust flange directed toward the end wall for providing shock absorption and noise reduction with movement of the roller across the U-shaped track to contact the end wall of the track.

11. The roller of claim 10 including a plurality of spaced thrust flanges.

12. The roller of claim 10 wherein the roller portion includes a rigid ring section interconnected with the hub portion and a flexible circumferential flange section extending outwardly away from the hub portion and with the flexible circumferential flange slightly compressed within the oppositely disposed first and second wall of the U-shaped track for providing shock absorption and noise reduction with movement of the roller across or along the track.

13. The roller of claim 12 wherein the roller portion is interconnected with the hub portion by a plurality of spaced rigid fins.

* * * * *